US009766560B2

(12) United States Patent
Kurachi

(10) Patent No.: US 9,766,560 B2
(45) Date of Patent: Sep. 19, 2017

(54) ELECTROPHOTOGRAPHIC PHOTORECEPTOR, IMAGE FORMING APPARATUS USING THE SAME, AND IMAGE FORMING METHOD

(71) Applicant: Konica Minolta, Inc., Tokyo (JP)

(72) Inventor: Masahiko Kurachi, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/259,627

(22) Filed: Sep. 8, 2016

(65) Prior Publication Data

US 2017/0075236 A1 Mar. 16, 2017

(30) Foreign Application Priority Data

Sep. 16, 2015 (JP) ..... 2015-183412

(51) Int. Cl.

*G03G 5/147* (2006.01)
*G03G 5/05* (2006.01)
*G03G 5/06* (2006.01)

(52) U.S. Cl.

CPC ..... *G03G 5/0507* (2013.01); *G03G 5/0546* (2013.01); *G03G 5/0575* (2013.01); *G03G 5/0614* (2013.01); *G03G 5/14704* (2013.01); *G03G 5/14708* (2013.01); *G03G 5/14734* (2013.01); *G03G 5/14769* (2013.01); *G03G 5/14791* (2013.01)

(58) Field of Classification Search

CPC ..... G03G 5/14704; G03G 5/14708
See application file for complete search history.

(56) References Cited

U.S. PATENT DOCUMENTS

2015/0099217 A1* 4/2015 Hatano ..... G03G 5/0575 430/56

FOREIGN PATENT DOCUMENTS

JP 2015114453 A 6/2015

* cited by examiner

*Primary Examiner* — Hoa V Le
(74) *Attorney, Agent, or Firm* — Lucas & Mercanti, LLP

(57) ABSTRACT

An electrophotographic photoreceptor for use in an image forming apparatus having a proximity charge-type charging unit includes a conductive support and at least photosensitive layer and surface layer laminated in order on the conductive support, wherein the surface layer includes (A) a charge transport material, (B) a cured product of a composition containing a polymerizable compound and inorganic fine particles, and (C) organic fine particles, and the inorganic fine particles contain a metal oxide, has a surface treated with a surface treatment agent having a reactive organic group, and has a volume resistivity of 1.2×1011Ω·cm or more.

7 Claims, 2 Drawing Sheets

ELECTROPHOTOGRAPHIC PHOTORECEPTOR, IMAGE FORMING APPARATUS USING THE SAME, AND IMAGE FORMING METHOD

The entire disclosure of Japanese Patent Application No. 2015-183412 filed on Sep. 16, 2015 including description, claims, drawings, and abstract are incorporated herein by reference in its entirety.

BACKGROUND OF THE INVENTION

Field of the Invention

The present invention relates to an electrophotographic photoreceptor, an image forming apparatus using the same, and an image forming method. More specifically, the present invention relates to an electrophotographic photoreceptor for use in a proximity charging-type image forming apparatus, an image forming apparatus using the electrophotographic photoreceptor, and an image forming method.

Description of the Related Art

A photoreceptor for use in an electrophotographic image forming apparatus (hereinafter, also referred to as "electrophotographic photoreceptor" or "photoreceptor") such as a copier or a printer is required to have high durability to be able to stably form an excellent image for a long time. However, wear caused by contact with a cleaning blade or the like, which is one of determinants of the life of a photoreceptor, is a limiting factor for the life expansion of an electrophotographic photoreceptor. An effective measure to reduce such wear is to allow the electrophotographic photoreceptor to have a surface layer formed using low-resistance metal oxide particles having a large particle diameter. However, such a surface layer is likely to increase a torque and reduces the cleanability of the photoreceptor. Therefore, JP 2015-114453 A proposes a photoreceptor having a surface layer containing melamine-formaldehyde condensation resin particles to improve cleanability.

However, the photoreceptor described in JP 2015-114453 A has a problem that when the photoreceptor is used in a proximity charging-type image forming apparatus, wear resistance and transfer memory resistance are not sufficiently compatible with each other. Further, in addition to these capabilities, a photoreceptor is required to have image deletion resistance and durability.

SUMMARY OF THE INVENTION

The present invention has been made in view of the above problem, and an object thereof is to provide an electrophotographic photoreceptor that is for use in a proximity charging-type image forming apparatus, has excellent wear resistance and transfer memory resistance, and also has excellent image deletion resistance and durability.

In order to achieve the above object, the prevent inventors have intensively studied, and as a result, have found that the above object can be achieved by an electrophotographic photoreceptor having a surface layer containing a charge transport material, surface-treated inorganic fine particles having a high volume resistivity, and organic fine particles. This finding has led to the completion of the present invention.

The above object of the present invention is achieved by the following configuration.

1. To achieve the abovementioned object, according to an aspect, an electrophotographic photoreceptor for use in an image forming apparatus having a proximity charge-type charging unit, reflecting one aspect of the present invention comprises a conductive support and at least photosensitive layer and surface layer laminated in order on the conductive support, wherein the surface layer comprises (A) a charge transport material, (B) a cured product of a composition containing a polymerizable compound and inorganic fine particles, and (C) organic fine particles, and the inorganic fine particles contain a metal oxide, has a surface treated with a surface treatment agent having a reactive organic group, and has a volume resistivity of $1.2\times10^{11}\Omega\cdot$cm or more.

2. The electrophotographic photoreceptor according to Item. 1, wherein the metal oxide is preferably $SiO_2$ or $Al_2O_3$.

3. The electrophotographic photoreceptor according to Item. 1 or 2, wherein the charge transport material is preferably represented by the following general formula (1):

[Chemical Formula 1]

(1)

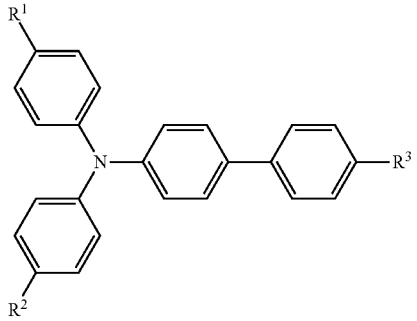

wherein, $R^1$ and $R^2$ are each independently a hydrogen atom or a methyl group, and $R^3$ is a linear or branched alkyl group having 1 to 5 carbon atoms, a methacryloyloxy group, or an acryloyloxy group.

4. The electrophotographic photoreceptor according to any one of Items. 1 to 3, wherein the photosensitive layer preferably has a film thickness of 15 μm or more but 20 μm or less.

5. The electrophotographic photoreceptor according to any one of Items. 1 to 4, wherein the organic fine particles are preferably melamine-formaldehyde condensation resin particles.

6. To achieve the abovementioned object, according to an aspect, an image forming apparatus reflecting one aspect of the present invention comprises: the electrophotographic photoreceptor according to any one of Items. 1 to 5; and the proximity charge-type charging unit in which AC is superimposed.

7. To achieve the abovementioned object, according to an aspect, a method for forming an image reflecting one aspect of the present invention comprises forming an electrophotographic image with a use of the image forming apparatus according to Item. 6.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
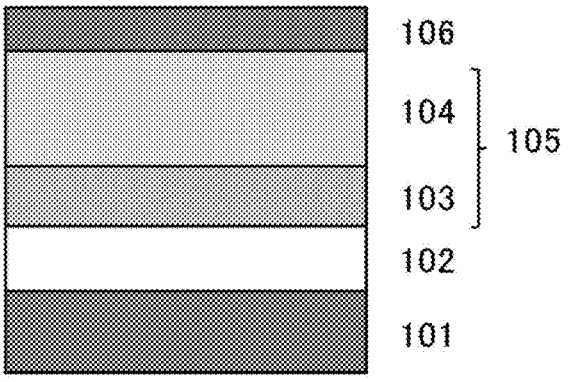
FIG. 1 is a schematic sectional view of an electrophotographic photoreceptor according to an embodiment of the present invention.

Hereinafter, an embodiment of the present invention will be described in detail with reference to the drawings. However, the scope of the invention is not limited to the illustrated examples.

In this specification, "X to Y" representing a range means "X or more but Y or less". Unless otherwise specified, operations and measurements of physical properties etc. are performed under conditions of room temperature (20 to 25° C.)/relative humidity of 40 to 50% RH.

According to an embodiment of the present invention, an electrophotographic photoreceptor is provided, which is for use in an image forming apparatus having a proximity charge-type charging unit and is obtained by laminating at least a photosensitive layer and a surface layer in order on a conductive support. The surface layer of the electrophotographic photoreceptor contains a charge transport material, a cured product of a composition containing a polymerizable compound and inorganic fine particles, and organic fine particles, and the inorganic fine particles contain a metal oxide, have a surface treated with a surface treatment agent having a reactive organic group, and have a volume resistivity of $1.2\times10^{11}\Omega\cdot$cm or more.

According to the present invention, an electrophotographic photoreceptor is provided, which is excellent not only in wear resistance and transfer memory resistance but also in image deletion resistance and durability. A mechanism for producing such an effect is not completely clear, but is estimated as follows.

In a proximity charging system, a photoreceptor receives a large amount of electric discharge from a charging member. A conventional photoreceptor contains, in its surface layer, conductive particles as a main component, and therefore electric discharge is concentrated on the vicinity of the conductive particles and its electric energy breaks chemical bonds in the surface layer, which deteriorates the surface layer. On the other hand, the photoreceptor according to the present invention uses surface-treated inorganic fine particles having a high volume resistivity instead of conductive particles, which prevents deterioration of its surface layer caused by concentrated electric discharge and improves its wear resistance. Further, the photoreceptor according to the present invention contains, in its surface layer, a charge transport material, which makes it possible to maintain excellent charging characteristics and prevent the occurrence of transfer memory.

When hydroxyl groups are present on the surface of the inorganic fine particles, a discharge product is less likely to be removed. Therefore, moisture is adsorbed to the discharge product under high-temperature and high-humidity conditions, which reduces the resistance of surface of the photoreceptor. As a result, a phenomenon occurs in which an electrostatic latent image is deleted in its surface direction (image deletion). However, the photoreceptor according to the present invention contains, in its surface layer, organic fine particles, which makes it possible to appropriately roughen the surface layer and improve the cleanability of the photoreceptor. As a result, the discharge product is easily removed, and therefore the occurrence of image deletion is prevented.

Further, the conventional photoreceptor causes a phenomenon in which when toner on the surface of the photoreceptor is removed by a cleaning blade after transfer, an external additive is released from the toner and slips through the cleaning blade. The external additive that has slipped through the cleaning blade remains on the surface of the photoreceptor and contaminates the charging member, which causes image defects during continuous printing. On the other hand, the photoreceptor according to the present invention contains organic fine particles in its surface layer, which reduces Van der Waals force that acts between the toner and the surface layer and therefore reduces the adhesion of the toner to the photoreceptor. Therefore, the toner scraping efficiency of the cleaning blade is improved. This makes it possible to efficiently remove the external additive from the surface of the photoreceptor, and therefore the photoreceptor has such durability that an excellent image can be formed for a long time.

Therefore, the photoreceptor according to the present invention can exhibit both excellent image deletion resistance and excellent durability.

It is to be noted that the present invention is not limited by the above mechanism at all.

Hereinbelow, an electrophotographic photoreceptor according to the present invention, an image forming apparatus using the same, and an image forming method will be described.

<Electrophotographic Photoreceptor>

FIG. 1 is a schematic sectional view of an electrophotographic photoreceptor according to an embodiment of the present invention. The electrophotographic photoreceptor according to this embodiment includes: a conductive support 101; and an intermediate layer 102, a photosensitive layer 105 including a charge generation layer 103 and a charge transport layer 104, and a surface layer 106 laminated in order on the conductive support 101. That is, the electrophotographic photoreceptor according to the present invention is obtained by laminating at least a photosensitive layer and a surface layer in order on a conductive support.

Hereinbelow, each of the layers constituting the photoreceptor will be described in detail.

[Conductive Support]

The conductive support to be used in the present invention may be any one having conductivity, and examples thereof include one obtained by molding a metal, such as aluminum, copper, chromium, nickel, zinc, or stainless steel, into a drum or sheet shape, one obtained by laminating a metal foil, such as aluminum foil or copper foil, on a plastic film, one obtained by evaporating aluminum, indium oxide, or tin oxide onto a plastic film, and one obtained by coating a metal or plastic film or a sheet of paper with a conductive material singly or in combination with a binder resin as a conductive layer.

[Photosensitive Layer]

The photosensitive layer of the electrophotographic photoreceptor according to the present invention preferably has two or more layers, and more preferably has a charge generation layer and a charge transport layer that will be described below.

The film thickness of the photosensitive layer (in the case of the photosensitive layer having two or more layers, the total film thickness of these layers) is preferably 40 μm or less, more preferably 30 μm or less, even more preferably 25 μm or less, particularly preferably 20 μm or less. When the film thickness of the photosensitive layer is 40 μm or less, the photoreceptor has excellent charging characteristics and can exhibit excellent transfer memory resistance and durability. Further, the film thickness of the photosensitive layer is preferably 2 μm or more, more preferably 5 μm or more, even more preferably 10 μm or more, particularly preferably 15 μm or more. When the film thickness of the photosensitive layer is 2 μm or more, charge leakage during charging can be prevented, and therefore discharge resistance is excellent.

That is, according to a preferred embodiment of the electrophotographic photoreceptor of the present invention, the film thickness of the photosensitive layer is 15 μm or more but 20 μm or less.

Hereinbelow, the charge generation layer and the charge transport layer will be described.

(Charge Generation Layer)

The charge generation layer used in the photoreceptor according to the present invention preferably contains a charge generation material and a binder resin, and is preferably formed by applying and drying a binder resin solution in which a charge generation material is dispersed.

Examples of the charge generation material include, but are not limited to, azo pigments such as Sudan Red and Dian Blue, quinone pigments such as pyrene quinone and anthanthrone, quinocyanine pigments, perylene pigments, indigo pigments such as indigo and thioindigo, polycyclic quinone pigments such as pyranthrone and diphthaloylpyrene, and phthalocyanine pigments. Preferred examples of the charge generation material include polycyclic quinone pigments and titanyl phthalocyanine pigments. These charge generation materials may be used singly or may be dispersed in a known binder resin.

Examples of the binder resin used for the charge generation layer include, but are not limited to, known resins such as polystyrene resins, polyethylene resins, polypropylene resins, acrylic resins, methacrylic resins, vinyl chloride resins, vinyl acetate resins, polyvinyl butyral resins, epoxy resins, polyurethane resins, phenol resins, polyester resins, alkyd resins, polycarbonate resins, silicone resins, melamine resins, copolymer resins containing two or more of these resins (e.g., vinyl chloride-vinyl acetate copolymer resins, vinyl chloride-vinyl acetate-maleic anhydride copolymer resins), and poly-vinylcarbazole resins. Preferred examples of the binder resin include polyvinyl butyral resins.

The charge generation layer is preferably formed in the following manner. The binder resin is dissolved in a solvent to obtain a solution, the charge generation material is dispersed in the solution with the use of a disperser to prepare a coating liquid, the coating liquid is applied with a coater to have a uniform film thickness, and the resulting coating film is dried. A coating method to be used may be the same as that described later with reference to the surface layer.

Examples of the solvent for dissolving and applying the binder resin used for the charge generation layer include, but are not limited to, toluene, xylene, methylene chloride, 1,2-dichloroethane, methyl ethyl ketone, cyclohexane, ethyl acetate, tert-butyl acetate, methanol, ethanol, propanol, butanol, methyl cellosolve, 4-methoxy-4-methyl-2-pentanone, ethyl cellosolve, tetrahydrofurane, 1,4-dioxane, 1,3-dioxolan, pyridine, and diethylamine. These solvents may be used singly or in combination of two or more of them.

Examples of a means for dispersing the charge generation material include, but are not limited to, an ultrasonic disperser, a ball mill, a sand mill, and a homogenizing mixer.

The ratio of the charge generation material to be mixed with the binder resin is preferably 1 to 600 parts by mass, more preferably 50 to 500 parts by mass per 100 parts by mass of the binder resin. The film thickness of the charge generation layer varies depending on the characteristics of the charge generation material, the characteristics of the binder resin, and the mixing ratio, but is preferably 0.01 to 5 μm, more preferably 0.05 to 3 μm. It is to be noted that the occurrence of image defects can be prevented by filtering out foreign matter and aggregates from the coating liquid for charge generation layer before coating. Alternatively, the charge generation layer may be formed by vacuum-evaporating the above pigment.

(Charge Transport Layer)

The charge transport layer used in the photoreceptor according to the present invention preferably contains a charge transport material and a binder resin, and is preferably formed by applying and drying a binder resin solution in which a charge transport material is dissolved.

Examples of the charge transport material that transports an electric charge (hole) include triphenylamine derivatives, hydrazone compounds, styryl compounds, benzidine compounds, and butadiene compounds.

Examples of the binder resin used for the charge transport layer include known resins such as polycarbonate resins, polyacrylate resins, polyester resins, polystyrene resins, styrene-acrylonitrile copolymer resins, polymethacrylate resins, and styrene-methacrylate copolymer resins. Among them, polycarbonate resins are preferred. These binder resins may be used singly or in combination of two or more of them. From the viewpoint of cracking resistance, wear resistance, and charging characteristics, bisphenol A (BPA), bisphenol Z (BPZ), dimethyl BPA, and a BPA-dimethyl BPA copolymer are preferred.

The charge transport layer is preferably formed in the following manner. The binder resin and the charge transport material are dissolved to prepare a coating liquid, the coating liquid is applied with a coater to have a uniform film thickness, and the resulting coating film is dried. A coating method to be used may be the same as that described later with reference to the surface layer.

Examples of the solvent for dissolving the binder resin and the charge transport material include, but are not limited to, toluene, xylene, methylene chloride, 1,2-dichloroethane, methyl ethyl ketone, cyclohexanone, ethyl acetate, butyl acetate, methanol, ethanol, propanol, butanol, tetrahydrofurane, 1,4-dioxane, 1,3-dioxolan, pyridine, and diethylamine. These solvents may be used singly or in combination of two or more of them.

The ratio of the charge transfer material to be mixed with the binder resin is preferably 10 to 500 parts by mass, more preferably 20 to 250 parts by mass per 100 parts by mass of the binder resin.

The film thickness of the charge transport layer varies depending on the characteristics of the charge transport material, the characteristics of the binder resin, and the mixing ratio, but is preferably 5 to 40 μm, more preferably 10 to 30 μm.

An antioxidant, a conducting agent, a stabilizer, silicone oil, and/or the like may be added to the charge transport layer. Examples of the antioxidant include compounds described in, for example, JP 2000-305291 A. Examples of the conducting agent include compounds described in, for example, JP 50-137543 A and JP 58-76483 A.

[Surface Layer]

(Constituent Materials of Surface Layer)

The surface layer of the electrophotographic photoreceptor according to the present invention contains (A) a charge transport material, (B) a cured product of a composition containing a polymerizable compound (b1) and inorganic fine particles (b2), and (C) organic fine particles. Each of the components will be described below.

<<(A) Charge Transport Material>>

The surface layer of the electrophotographic photoreceptor according to the present invention preferably contains a compound represented by the following general formula (1) as a charge transport material.

[Chemical Formula 2]

(1)

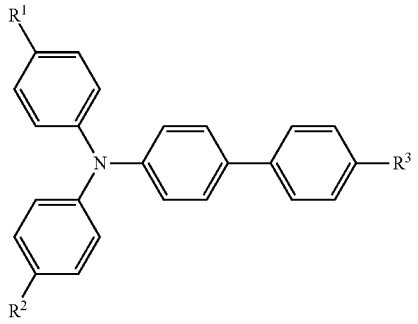

In the above general formula (1), $R^1$ and $R^2$ are each independently a hydrogen atom or a methyl group, and $R^3$ is a linear or branched alkyl group having 1 to 5 carbon atoms, a methacryloyloxy group, or an acryloyloxy group.

The compound represented by the above general formula (1) is a charge transport material that transports charge carriers in the surface layer. The charge transport material shows no absorption in the short-wavelength region and often has a molecular weight of 450 or less (preferably 320 or more but 450 or less), and therefore can enter voids in the cured product of the surface layer. Therefore, charge carriers can be smoothly injected from the charge transport layer without reducing the wear resistance of the surface layer, and an electric charge can be transported to the surface of the surface layer while a residual potential hardly increases or transfer memory hardly occurs.

As described above, $R^1$ and $R^2$ in the above general formula (1) are each independently a hydrogen atom or a methyl group, but from the viewpoint of production stability, $R^1$ and $R^2$ are preferably different from each other.

Examples of the C1 to C5 linear or branched alkyl group used as $R^3$ in the above general formula (1) include a methyl group, an ethyl group, a propyl group, an isopropyl group, an n-butyl group, an isobutyl group, a tert-butyl group, an n-pentyl group, an isopentyl group, a neopentyl group, a tert-pentyl group, and a 2-methyl butyl group. Among them, from the viewpoint of solubility, a propyl group, an n-butyl group, a tert-butyl group, and an n-pentyl group are preferred.

From the viewpoint of preventing a reduction in the hardness of the surface layer, $R^3$ in the above general formula (1) preferably has a functional group polymerizable with the polymerizable compound that will be described later, more preferably has an acryloyloxy group or a methacryloyloxy group. Further, from the viewpoint that even when the functional group remains, its influence on image deletion resistance is small, a methacryloyloxy group is more preferred.

Specific examples of the compound represented by the above general formula (1) are shown below.

[Chemical Formula 3]

$^F$(1)

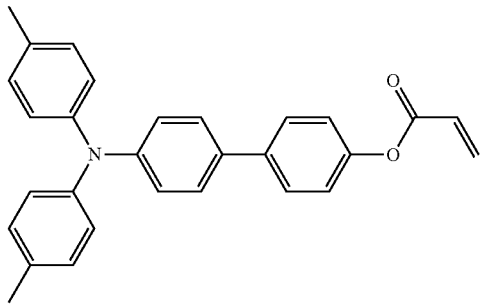

$^F$(2)

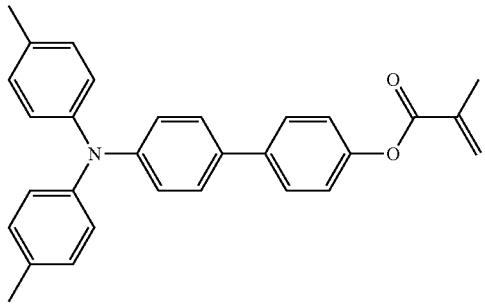

$^F$(3)

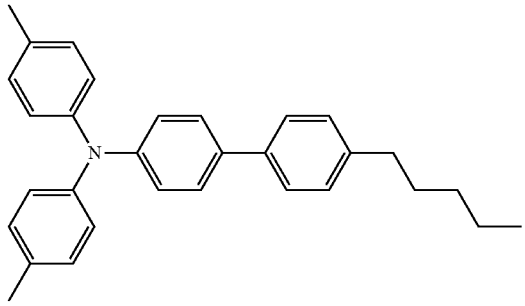

$^F$(4)

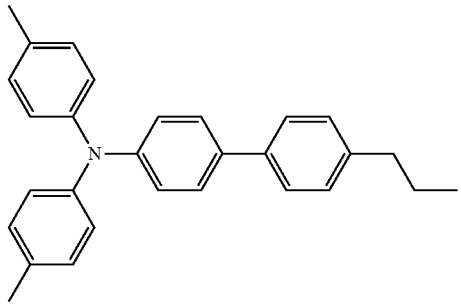

-continued

F(5)

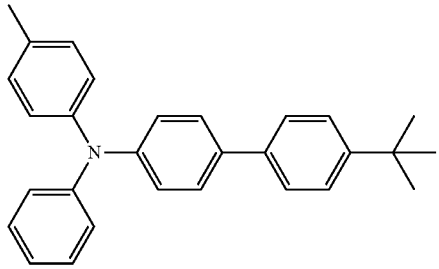

The charge transport material to be used may be a commercialized product or a synthetic compound. A synthetic method may be, for example, one described in JP 2006-143720 A. The above charge transport materials may be used singly or in combination of two or more of them.

The amount of the charge transport material represented by the general formula (1) contained in the surface layer is preferably 10 to 65 parts by mass, more preferably 20 to 55 parts by mass, even more preferably 30 to 50 parts by mass, particularly preferably 35 to 45 parts by mass per 100 parts by mass of the polymerizable compound that will be described later.

<<(b1) Polymerizable Compound>>

The polymerizable compound to be used in the present invention is preferably a monomer that is polymerized (cured) by irradiation with activation energy such as ultraviolet beams or electron beams to form a resin, such as polystyrene or poly(meth)acrylate, to be generally used as a binder resin for a photoreceptor. Particularly, a styrene-based monomer, an acrylic monomer, a methacrylic monomer, a vinyltoluene-based monomer, a vinyl acetate-based monomer, and an N-vinylpyrrolidone-based monomer are preferred.

Among them, a radical polymerizable monomer having a polymerizable unsaturated group such as an acryloyl group ($CH_2{=}CHCO{-}$) or a methacryloyl group ($CH_2{=}CCH_3CO{-}$) or an oligomer thereof is preferred because such a radical polymerizable monomer or its oligomer can be cured with a small amount of light or in a short time. Further, from the viewpoint that even when the functional group remains, its influence on image deletion resistance is small, a methacryloyloxy group is more preferred.

In the present invention, the above polymerizable compounds may be used singly or in combination of two or more of them. These polymerizable compounds may be used in the form of monomer or oligomer.

Examples of these polymerizable compounds include, but are not limited to, the following compounds. The polymerizable compounds exemplified below are known compounds, and are therefore commercially available.

[Chemical Formula 4]

M1

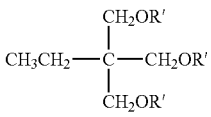

M2

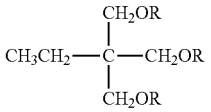

-continued

M3

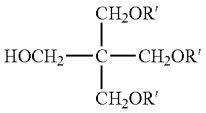

M4

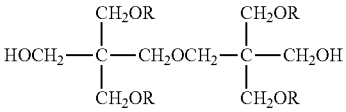

M5

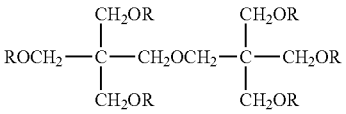

M6

M7

M8

M9

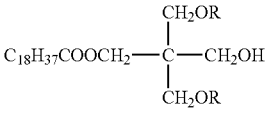

M10

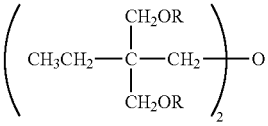

M11

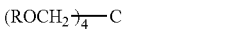

M12

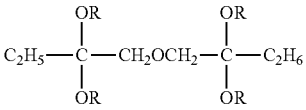

M13

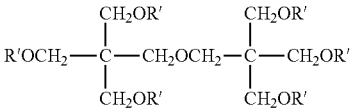

M14

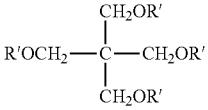

wherein R is an acryloyl group and R' is a methacryloyl group (see the following chemical formulas).

[Chemical Formula 5]

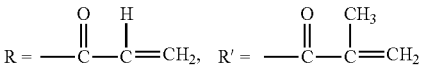

Among the above exemplified compounds, the compounds M1, M2, and M3 are polymerizable compounds to be preferably used in the present invention.

The polymerizable compound to be used is preferably a compound having three or more polymerizable unsaturated groups. The polymerizable compound to be used may be a combination of two or more compounds, but also in this case, a compound having three or more polymerizable unsaturated groups is preferably used in an amount of 50 mass % or more per 100 mass % of the polymerizable compound. Further, a polymerizable unsaturated group equivalent, that is, "the molecular weight of a compound having a polymerizable unsaturated group/the number of unsaturated groups" is preferably 1000 or less, more preferably 500 or less. This increases cross-linking density and improves wear resistance.

In the present invention, the surface layer is formed by a curing reaction of the polymerizable compound. When the polymerizable compound is reacted, for example, a method is used in which the polymerizable compound is reacted by electron-beam cleavage, or a method is used in which the polymerizable compound is photo-polymerized or heat-polymerized by adding a radical polymerization initiator. The polymerization initiator to be used may be either a photopolymerization initiator or a thermal polymerization initiator. Alternatively, both a photopolymerization initiator and a thermal polymerization initiator may be used in combination.

Examples of the thermal polymerization initiator include: azo compounds such as 2,2'-azobisisobutyronitrile, 2,2'-azobis(2,4-dimethylazobisvaleronitrile), and 2,2'-azobis(2-methylbutyronitrile); and peroxides such as benzoyl peroxide (BPO), di-tert-butyl hydroperoxide, tert-butylhydroperoxide, chlorobenzoyl peroxide, dichlorobenzoyl peroxide, bromomethylbenzoyl peroxide, and lauroyl peroxide.

Examples of the photopolymerization initiator include: acetophenone- or ketal-based photopolymerization initiators such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-morpholinophenyl)butanone-1 ("Irgacure 369" manufactured by BASF Japan Ltd.), 2-hydroxy-2-methyl-1-phenylpropane-1-one, 2-methyl-2-morpholino(4-methylthiophenyl)propane-1-one, and 1-phenyl-1,2-propanedione-2-(o-ethoxycarbonyl)oxime; benzoin ether-based photopolymerization initiators such as benzoin, benzoin methyl ether, benzoin ethyl ether, benzoin isobutyl ether, and benzoin isopropyl ether; benzophenone-based photopolymerization initiators such as benzophenone, 4-hydroxybenzophenone, methyl o-benzoylbenzoate, 2-benzoylnaphthalene, 4-benzoylbiphenyl, 4-benzoyl phenyl ether, acrylated benzophenone, and 1,4-benzoyl benzene; and thioxanthone-based photopolymerization initiators such as 2-isopropylthioxanthone, 2-chlorothioxanthone, 2,4-dimethylthioxanthone, 2,4-diethylthioxanthone, and 2,4-dichlorothioxanthone.

Examples of another photopolymerization initiator include ethylanthraquinone, 2,4,6-trimethylbenzoyl diphenylphosphine oxide, 2,4,6-trimethylbenzoyl phenylethoxyphosphine oxide, bis(2,4,6-trimethylbenzoyl)phenylphosphine oxide ("Irgacure (registered trademark) 819" manufactured by BASF Japan Ltd.), bis(2,4-dimethoxybenzoyl)-2,4,4-trimethylpentylphosphine oxide, methylphenylglyoxy ester, 9,10-phenanthrene, acridine-based compounds, triazine-based compounds, and imidazole-based compounds. A photopolymerization promoter having the effect of promoting photopolymerization may be used singly or in combination with the above-described photopolymerization initiator. Examples of the photopolymerization promoter include triethanolamine, methyl diethanolamine, ethyl 4-dimethylaminobenzoate, isoamyl 4-dimethylaminobenzoate, ethyl(2-dimethylamino)benzoate, and 4,4'-dimethylaminobenzophenone.

The radical polymerization initiator is preferably a photopolymerization initiator, particularly preferably an alkylphenone-based compound or a phosphine oxide-based compound. Particularly, a compound having an α-aminoalkylphenone structure or an acylphosphine oxide structure is preferred.

These polymerization initiators may be used singly or in combination of two or more of them. The amount of the polymerization initiator to be contained is preferably 0.5 to 30 parts by mass, more preferably 2 to 15 parts by mass per 100 parts by mass of the polymerizable compound.

<<(b2) Inorganic Fine Particles>>

The inorganic fine particles to be used in the present invention are cured (polymerized) together with the above-described polymerizable compound to forma cured product in the surface layer. This makes it possible to obtain a surface layer having high hardness.

The inorganic fine particles according to the present invention contain a metal oxide. The metal oxides may be used singly or in combination of two or more of them.

Examples of the metal oxide include silicon oxide (silica), magnesium oxide, zinc oxide, lead oxide, aluminum oxide (alumina), zirconium oxide, tin oxide, titanium oxide (titania), niobium oxide, molybdenum oxide, and vanadium oxide. Among them, from the viewpoint of hardness, insulating properties, and optical transparency, silicon oxide (silica, $SiO_2$) and aluminum oxide (alumina, $Al_2O_3$) are preferred.

The silica may be either hydrophilic silica or hydrophobic silica. From the viewpoint of surface treatment using a reactive organic group-containing surface treatment agent that will be described later, hydrophilic silica is preferred. It is to be noted that the silica to be used may be either dry silica (fumed silica) or wet silica. Examples of hydrophilic fumed silica to be used include commercialized products such as AEROSIL (registered trademark) 90, AEROSIL (registered trademark) 130, AEROSIL (registered trademark) 150, AEROSIL (registered trademark) 200, AEROSIL (registered trademark) 255, AEROSIL (registered trademark) 300, AEROSIL (registered trademark) 380, AEROSIL (registered trademark) OX50, AEROSIL (registered trademark) TT600, AEROSIL (registered trademark) 200 Pharma, and AEROSIL (registered trademark) 300 Pharma (all of them are manufactured by NIPPON AEROSIL CO., LTD) and SFP-20M (manufactured by Denka Company Limited). The alumina may be either hydrophilic alumina or hydrophobic alumina, but is preferably hydrophilic alumina for the same reason as the silica. The hydrophilic alumina to be used may be a commercialized product such as Nanotek (registered trademark) (C.I. Kasei Company, Limited).

That is, in a preferred embodiment of the electrophotographic photoreceptor according to the present invention, the metal oxide contained in the surface layer is $SiO_2$ or $Al_2O_3$.

The inorganic fine particles according to the present invention may be composite particles having a core-shell structure which are obtained by attaching a metal oxide as a coating material (shell material) to the surface of a core material. The composite particles having a core-shell structure may be ones whose core material surface is partially exposed or ones whose core material surface is completely coated with the coating material.

When the inorganic fine particles are composite particles having a core-shell structure, the core material to be used is an insulating material, and is specifically at least one of barium sulfate, silicon oxide, aluminum oxide, and the like.

From the viewpoint of optical transparency, the core material is particularly preferably barium sulfate. The metal oxide as a coating material is, for example, at least one of silicon oxide, aluminum oxide, calcium oxide, and the like. The use of the metal oxide makes it possible to ensure not only optical transparency but also electric insulation and therefore to maintain excellent image characteristics and wear resistance.

The amount of the metal oxide to be attached to the core material is preferably 30 to 80 mass %, more preferably 40 to 70 mass % with respect to the mass of the core material. A method for attaching the metal oxide as a coating material to the core material may be, for example, a method disclosed in JP 2009-255042 A.

The lower limit of the average primary particle diameter of the inorganic fine particles according to the present invention before surface treatment is preferably 3 nm or more, more preferably 10 nm or more, even more preferably 15 nm or more. The upper limit of the average primary particle diameter of the inorganic fine particles according to the present invention before surface treatment is preferably 150 nm or less, more preferably 50 nm or less, even more preferably 35 nm or less. When the average primary particle diameter of the inorganic fine particles is within the above range, it is possible to ensure sufficiently high film strength. It is to be noted that the average primary particle diameter can be determined by measuring the volume-basis particle dimeter of the particles by laser diffractometry.

[Surface Treatment Agent having Reactive Organic Group]

The inorganic fine particles contained in the surface layer of the electrophotographic photoreceptor according to the present invention have been subjected to surface treatment using a surface treatment agent having a reactive organic group.

The surface treatment agent having a reactive organic group to be used is a surface treatment agent (silane coupling agent, titanium coupling agent, or the like) having reactivity with a hydroxyl group or the like present on the surface of the inorganic fine particles. The reactive organic group is preferably an ionic polymerizable functional group such as a cyclic ether (epoxy, oxetane, or the like) or a radical polymerizable functional group, more preferably a radical polymerizable functional group. The radical polymerizable functional group can be reacted also with the polymerizable compound having a polymerizable unsaturated group so that a hard surface layer can be formed. Examples of the radical polymerizable functional group include a vinyl group, an acryloyl group, and a methacryloyl group, and a silane coupling agent having such a radical polymerizable functional group is preferred. Examples of such a surface treatment agent as described above include compounds represented by the following chemical formulas S-1 to S-30.

[Chemical Formula 6]

$CH_2{=}CHSi(CH_3)(OCH_3)_2$ S-1

$CH_2{=}CHSi(OCH_3)_3$ S-2

$CH_2{=}CHSiCl_3$ S-3

$CH_2{=}CHCOO(CH_2)_2Si(CH_3)(OCH_3)_2$ S-4

$CH_2{=}CHCOO(CH_2)_2Si(OCH_3)_2$ S-5

$CH_2{=}CHCOO(CH_2)_3Si(CH_3)(OCH_3)_2$ S-6

$CH_2{=}CHCOO(CH_2)_2Si(OCH_3)_2$ S-7

$CH_2{=}CHCOO(CH_2)_2Si(CH_3)Cl_2$ S-8

$CH_2{=}CHCOO(CH_2)SiCl_3$ S-9

$CH_2{=}CHCOO(CH_2)_3Si(CH_3)Cl_2$ S-10

$CH_2{=}CHCOO(CH_2)_3SiCl_3$ S-11

$CH_2{=}C(CH_3)COO(CH_2)_2Si(CH_3)(OCH_3)_2$ S-12

$CH_2{=}C(CH_3)COO(CH_2)_2Si(OCH_3)_3$ S-13

$CH_2{=}C(CH_3)COO(CH_2)_2Si(CH_3)(OCH_3)_2$ S-14

$CH_2{=}C(CH_3)COO(CH_2)_2Si(OCH_3)_3$ S-15

$CH_2{=}C(CH_3)COO(CH_2)_2Si(CH_3)Cl_2$ S-16

$CH_2{=}C(CH_3)COO(CH_2)_2SiCl_3$ S-17

$CH_2{=}C(CH_3)COO(CH_2)_2Si(CH_3)Cl_2$ S-18

$CH_2{=}C(CH_3)COO(CH_2)_2SiCl_3$ S-19

$CH_2{=}CHSi(C_2H_6)(OCH_3)_2$ S-20

$CH_2{=}C(CH_3)Si(OCH_3)_3$ S-21

$CH_2{=}C(CH_3)Si(OC_2H_6)_3$ S-22

$CH_2{=}CHSi(OCH_3)_3$ S-23

$CH_2{=}C(CH_3)Si(CH_3)(OCH_3)_2$ S-24

$CH_2{=}CHSi(CH_3)Cl_2$ S-25

$CH_2{=}CHCOOSi(OCH_3)_2$ S-26

$CH_2{=}CHCOOSi(OC_2H_6)_3$ S-27

$CH_2{=}C(CH_3)COOSi(OCH_3)_3$ S-28

$CH_2{=}C(CH_3)COOSi(OC_2H_6)_3$ S-29

$CH_2{=}C(CH_3)COO(CH_2)_3Si(OC_2H_6)_3$ S-30

Among the above compounds, the compounds S-4 to S-7 and S-12 to S-15 are preferred, each of which has a methoxy group on one of its ends and an acryloyl or methacryloyl group on the other end. Particularly, from the viewpoint that even when the functional group remains, its influence on image deletion resistance is small, the compounds S-12 to S-15 are preferred, each of which has a methoxy group on one of its ends and a methacryloyl group on the other end. Further, from the viewpoint of dispersion stability of the inorganic fine particles and the electric characteristics of the photoreceptor, the compound S-15 is particularly preferred.

The surface treatment agent to be used may be a silane compound, other than the above compounds S-1 to S-30, having a radical polymerizable reactive organic group. These surface treatment agents may be used singly or in combination of two or more of them.

[Method for Producing Inorganic Fine Particles Treated with Surface Treatment Agent Having Reactive Organic Group]

A method for obtaining the surface-treated inorganic fine particles according to the present invention is not particularly limited, but may be the following method. For example, a method may be used in which the surface treatment agent having a reactive organic group is added to a slurry containing the inorganic fine particles and a solvent, the slurry is heated with stirring to perform surface treatment, and then the solvent is removed. Alternatively, for example, a method may be used in which a slurry containing the inorganic fine particles, the surface treatment agent having a reactive organic group, and a solvent is prepared, the inorganic fine particles are subjected to wet grinding using a wet media-type dispersing device and surface treatment, and then the solvent is removed.

The amount of the surface treatment agent having a reactive organic group to be used for surface treatment is preferably 0.1 to 200 parts by mass, more preferably 7 to 70 parts by mass per 100 parts by mass of the inorganic fine particles before surface treatment.

The amount of the solvent to be used to prepare the slurry is preferably 30 to 1000 parts by mass per 100 parts by mass of the inorganic fine particles before surface treatment. Examples of the solvent to be used include toluene, xylene, methylene chloride, 1,2-dichloroethane, methyl ethyl ketone, cyclohexane, ethyl acetate, tert-butyl acetate, methanol, ethanol, n-propyl alcohol, isopropyl alcohol, n-butyl alcohol, tert-butyl alcohol, sec-butyl alcohol, methyl cellosolve, 4-methoxy-4-methyl-2-pentanone, ethyl cellosolve, tetrahydrofurane, 1,4-dioxane, 1,3-dioxolan, pyridine, and diethylamine. The above solvents may be used singly or in combination of two or more of them.

When the surface treatment is performed by heating with stirring, an atmosphere in which the surface treatment is performed is preferably nitrogen, and a heating temperature is preferably 30 to 80° C.

The lower limit of volume resistivity of the inorganic fine particles according to the present invention after surface treatment is $1.2\times10^{11}\Omega\cdot$cm or more, preferably $1.0\times10^{12}\Omega\cdot$cm or more, more preferably $1.0\times10^{13}\Omega\cdot$cm or more, even more preferably $1.0\times10^{14}\Omega\cdot$cm or more, particularly preferably $3.0\times10^{14}\Omega\cdot$cm or more. If the volume resistivity is less than $1.2\times10^{11}\Omega\cdot$cm, electric discharge is concentrated on the inorganic fine particles so that the strength of the surface layer (particularly, areas surrounding the inorganic fine particles) is reduced and therefore the photoreceptor wears. The upper limit of volume resistivity of the inorganic fine particles according to the present invention is not particularly limited, but is preferably $1.0\times10^{18}\Omega\cdot$cm or less, more preferably $1.0\times10^{16}\Omega\cdot$cm or less, even more preferably $2.0\times10^{15}\Omega\cdot$cm or less, particularly preferably $8.0\times10^{14}\Omega\cdot$cm or less. When the upper limit of volume resistivity of the inorganic fine particles is within the above range, the photoreceptor has excellent electric characteristics (e.g., potential after exposure, residual potential) and excellent transfer memory resistance and durability.

The volume resistivity of the inorganic fine particles can be determined in the following manner. The inorganic fine particles are placed on the surface of a circular tool having an electrode plate with an area of 20 $cm^2$ to form an inorganic fine particle layer having a thickness of about 1 to 3 mm. The same electrode plate with an area of 20 $cm^2$ as described above is placed on the inorganic fine particle layer to sandwich the inorganic fine particle layer between the electrode plates. A load of 4 kg is applied onto the electrode plate placed on the inorganic fine particle layer to fill gaps between the inorganic fine particles, and the thickness (cm) of the inorganic fine particle layer is measured. The two electrode plates sandwiching the inorganic fine particle layer are connected to an electrometer and a high-voltage power source to apply a predetermined voltage to the electrode plates, and a current value (A) flowing at this time is measured. The volume resistivity p ($\Omega\cdot$cm) of the inorganic fine particles is calculated from the current value using the following formula.

$$\rho=E\times20/(I-I_0)/L \quad \text{[Formula 1]}$$

In the above formula, E is an applied voltage (V), I is a current value (A) during the application of voltage, $I_0$ is a current value (A) at an applied voltage of 0 V, and L is the thickness (cm) of the inorganic fine particle layer. It is to be noted that in the present invention, a volume resistivity determined under conditions of a temperature of 20° C., a relative humidity of 50% RH, and an applied voltage of 1000 V is used as the volume resistivity of the inorganic fine particles.

The amount of the surface-treated inorganic fine particles to be contained in the surface layer is preferably 5 to 50 parts by mass, more preferably 10 to 40 parts by mass, even more preferably 17 to 35 parts by mass per 100 parts by mass of the above-described polymerizable compound.

<<(C) Organic Fine Particles>>

The surface layer of the electrophotographic photoreceptor according to the preset invention contains organic fine particles. When the surface layer contains organic fine particles, the surface of the photoreceptor is appropriately roughened, and Van der Waars force acting between the surface layer and toner is reduced, which makes it possible to improve the cleanability of the photoreceptor.

The organic fine particles to be used in the present invention are preferably particles containing a melamine resin such as a melamine-formaldehyde polycondensation-type melamine resin or a melamine-benzoguanamine-formaldehyde copolycondensation-type melamine resin, a benzoguanamine resin, a styreneacrylic resin, or a silicone resin. The organic fine particles may be ones whose surface has been treated with a silane coupling agent or the like.

Among them, from the viewpoint of toner cleanability or prevention of image density variations, a melamine-formaldehyde polycondensation-type melamine resin or a styreneacrylic resin is preferably contained. Further, from the viewpoint of reducing Van der Waals force acting on toner, a melamine-formaldehyde polycondensation-type melamine resin is particularly preferred. That is, in a preferred embodiment of the electrophotographic photoreceptor according to the present invention, the organic fine particles contained in the surface layer of the photoreceptor are melamine-formaldehyde condensation resin particles.

Examples of the melamine-formaldehyde polycondensation-type melamine resin particles to be used include commercialized products such as EPOSTAR (registered trademark) S, EPOSTAR (registered trademark) S6, and EPOSTAR (registered trademark) S12 (all of them are manufactured by NIPPON SHOKUBAI CO., LTD), and examples of the melamine-benzoguanamine-formaldehyde copolycondensation-type melamine resin particles to be used include commercialized products such as EPOSTAR (registered trademark) MS (manufactured by NIPPON SHOKUBAI CO., LTD.). Examples of the styreneacrylic resin particles to be used include commercialized products such as FINE SPHERE MG-351, MG-451, FS-102, FS-201, and FS-301 (all of them are manufactured by Nippon Paint Co., Ltd.).

The number-average primary particle diameter of the organic fine particles is preferably in the range of 0.01 to 3 μm, more preferably 0.1 to 2 μm, even more preferably 0.3 to 1.5 μm. When the number-average primary particle diameter of the organic fine particles is within the above range, the surface of the photoreceptor can be appropriately roughened, which makes it possible to ensure excellent cleanability.

It is to be noted that the number-average primary particle diameter of the organic fine particles can be measured in the following manner.

First, the photosensitive layer including the surface layer is cut out as a measurement sample from the surface of the photoreceptor with the use of a knife or the like, and then the measurement sample is attached to an arbitrary holder so that its cutting surface faces upward. Then, the measurement sample is observed with a scanning electron microscope. A photograph is taken through the microscope at a magnification of 30000, and 100 organic fine particles are randomly extracted on the photographic image to calculate a number-average primary particle diameter. More specifically, the photographic image is binarized by an automatic image analyzer "LUZEX AP" (manufactured by NIRECO CORPORATION), and the horizontal Feret diameter of each of the 100 organic fine particles is measured to calculate an arithmetic mean. The arithmetic mean is defined as a number-average primary particle diameter.

The amount of the organic fine particles to be contained in the surface layer is preferably 5 to 45 parts by mass, more preferably 12 to 40 parts by mass, even more preferably 17 to 35 parts by mass, particularly preferably 22 to 32 parts by mass per 100 parts by mass of the above-described polymerizable compound.

(Method for Forming Surface Layer)

The surface layer according to the present invention can be formed by mixing the charge transport material represented by the above general formula (1), the polymerizable compound, the inorganic fine particles, the organic fine particles, and if necessary, the polymerization initiator or the like in a solvent to prepare a coating liquid (coating liquid for surface layer), applying the coating liquid onto the above-described photosensitive layer, and drying and curing the coating liquid.

In the above processes of application, drying, and curing, a reaction of the polymerizable compound, a reaction between the polymerizable compound and the reactive organic group of the surface-treated inorganic fine particles, and a reaction between the surface-treated inorganic fine particles proceed so that a surface layer is formed.

The solvent to be used for the coating liquid for surface layer may be any solvent as long as the charge transport material, the polymerizable compound, the surface-treated inorganic fine particles, and the organic fine particles can be dissolved or dispersed in the solvent. Specific examples of the solvent include, but are not limited to, methanol, ethanol, propanol, isopropanol, 1-butanol, 2-butanol, tert-butanol, dibenzyl alcohol, toluene, xylene, methylene chloride, methyl ethyl ketone, cyclohexane, ethyl acetate, butyl acetate, methyl cellosolve, ethyl cellosolve, tetrahydrofurane, 1,4-dioxane, 1,3-dioxolan, pyridine, and diethylamine. These solvents may be used singly or in combination of two or more of them.

A method for preparing the coating liquid is not particularly limited, either. The coating liquid may be prepared by adding the charge transport material, the polymerizable compound, the surface-treated inorganic fine particles, the organic fine particles, and if necessary, various additives to the solvent and mixing them with stirring until they are dissolved or dispersed in the solvent. The amount of the solvent is not particularly limited, either, and may be appropriately adjusted so that the coating liquid has a viscosity suitable for coating operation.

A coating method to be used is not particularly limited, and may be, for example, a known method such as immersion coating, spray coating, spinner coating, bead coating, blade coating, beam coating, slide hopper coating, or circular slide hopper coating.

After being applied, the coating liquid is naturally or thermally dried to forma coating film. Then, the coating film is cured by irradiation with activation energy beams to generate a cured product of a composition containing the polymerizable compound as a monomer compound and the surface-treated inorganic fine particles. The activation energy beams are preferably ultraviolet beams or electron beams, more preferably ultraviolet beams.

Any ultraviolet source can be used without any limitation as long as it is a light source that produces ultraviolet beams. Examples of such a light source to be used include a low-pressure mercury lamp, a medium-pressure mercury lamp, a high-pressure mercury lamp, an ultrahigh-pressure mercury lamp, a carbon-arc lamp, a metal halide lamp, a xenon lamp, and a flash (pulse) xenon lamp. Irradiation conditions vary depending on the type of lamp used, but the dose of ultraviolet beams is usually 5 to 500 $mJ/cm^2$, preferably 5 to 100 $mJ/cm^2$. The output of the light source is preferably 0.1 to 5 kW, more preferably 0.3 to 3 kW.

An electron beam irradiator to be used as an electron beam source is not particularly limited. Generally, a curtain beam-type irradiator that produces high power relatively inexpensively is appropriately used as an electron beam accelerator for electron beam irradiation. The acceleration voltage during electron beam irradiation is preferably 100 to 300 kV. The adsorbed dose is preferably 0.5 to 10 Mrad.

The irradiation time to obtain the required dose of activation energy irradiation is preferably 0.1 sec to 10 min, and, from the viewpoint of operation efficiency, is more preferably 0.1 sec to 5 min.

In the process of forming the surface layer, drying can be performed before or after irradiation with activation energy beams or during irradiation with activation energy beams, and the timing of drying can be appropriately selected from combinations of them.

The conditions of drying can be appropriately selected depending on, for example, the type of solvent used or the film thickness of the surface layer. The temperature of drying is preferably 20 to 180° C., more preferably 20 to 140° C. The time of drying is preferably 1 to 200 minutes, more preferably 5 to 100 minutes.

The film thickness of the surface layer is preferably 0.5 to 6.0 μm, more preferably 1.0 to 5.0 μm, even more preferably 1.5 to 4.0 μm, particularly preferably 2.0 to 3.0 μm. When the film thickness of the surface layer is 6.0 μm or less, the photoreceptor has excellent potential characteristics after exposure, and when the film thickness of the surface layer is 0.5 μm or more, the photoreceptor can be prevented from being deteriorated by wear.

[Another Layer]

In the present invention, a layer other than the photosensitive layer and the surface layer may be provided on the conductive support. Particularly, from the viewpoint of failure prevention, an intermediate layer having a barrier function and an adhesion function is preferably provided between the conductive support and the photosensitive layer.

The intermediate layer can be formed in the following manner. A binder resin such as casein, polyvinyl alcohol, nitrocellulose, an ethylene-acrylic acid copolymer, a polyamide resin, a polyurethane resin, or gelatin is dissolved in a known solvent to prepare a coating liquid, and then the coating liquid is applied and dried by the same coating method (e.g., immersion coating) and drying method as described above with reference to the surface layer. Among these binder resins, an alcohol-soluble polyamide resin is preferred. These binder resins may be used singly or in combination of two or more of them.

For the purpose of adjusting the resistance of the intermediate layer, the intermediate layer may contain various conductive particles or inorganic particles such as metal oxide particles. Examples of the metal oxide particles to be used include: particles of various metal oxides such as alumina, zinc oxide, titanium oxide, tin oxide, antimony oxide, indium oxide, and bismuth oxide; and particles of tin-doped indium oxide (ITO), antimony-doped tin oxide (ATO), and zirconium oxide.

These metal oxide particles may be used singly or in combination of two or more kinds of them. When two or more kinds of metal oxide particles are used in combination, they may be in the form of solid solution or fusion. The average primary particle dimeter of the metal oxide particles is preferably 0.3 μm or less, more preferably 0.1 μm or less. On the other hand, the lower limit of the average primary particle diameter is not particularly limited, but is preferably 0.006 μm or more. The average primary particle diameter of the metal oxide particles can be measured by the same method as described above with reference to the average primary particle diameter of the inorganic fine particles.

The solvent to be used for the coating liquid for the intermediate layer is preferably one in which the above-described metal oxide particles are well dispersed and the binder resin, especially a polyamide resin, is dissolved. Specifically, the solvent is preferably an alcohol having 1 to 4 carbon atoms, such as methanol, ethanol, n-propyl alcohol, isopropyl alcohol, n-butyl alcohol, tert-butyl alcohol, or sec-butyl alcohol from the viewpoint of excellent solubility and coatability of a polyamide resin. These solvents may be used singly or in combination of two or more of them. Further, the solvent may be used in combination with a co-solvent to improve storage stability and the dispersibility of the inorganic particles. Examples of the co-solvent capable of obtaining a positive effect include benzyl alcohol, toluene, methylene chloride, cyclohexanone, and tetrahydrofuran.

A method for forming the intermediate layer is not particularly limited. For example, the binder resin is dissolved in the solvent, the inorganic particles are dispersed therein using a device such as an ultrasonic disperser, a ball mill, a sand mill, or a homogenizing mixer to prepare a coating liquid, and then the coating liquid is applied onto the conductive support to form a coating layer having a desired thickness. Then, the coating layer is dried to complete an intermediate layer. A method for drying the intermediate layer can be appropriately selected depending on, for example, the type of solvent used or the film thickness of the intermediate layer, but is preferably heat drying.

The concentration of the binder resin in the coating liquid for forming the intermediate layer is appropriately selected depending on the film thickness of the intermediate layer or the speed of production.

The ratio of the inorganic particles to be mixed with the binder resin when the inorganic particles etc. are dispersed is preferably 20 to 400 parts by mass, more preferably 50 to 350 parts by mass per 100 parts by mass of the binder resin.

The film thickness of the intermediate layer is preferably 0.1 to 15 μm, more preferably 0.3 to 10 μm.

<Image forming Apparatus>

The above-described electrophotographic photoreceptor according to the present invention is used by attaching it to an image forming apparatus having a proximity charge-type charging unit to form a high-quality image. Therefore, the present invention also provides an image forming apparatus including the electrophotographic photoreceptor according to the present invention and a proximity charge-type charging unit.

The image forming apparatus according to the present invention preferably includes the photoreceptor according to the present invention, a proximity charge-type charging unit for charging a surface of the photoreceptor, an exposure unit for exposing the charged photoreceptor to light to form an electrostatic latent image, a developing unit for developing the latent image on the photoreceptor with toner to form a toner image, and a cleaning unit.

As the charging unit, a proximity charge-type charging unit is used. The photoreceptor according to the present invention is used in an image forming apparatus having a proximity charge-type charging unit.

The proximity charge-type charging unit is disposed in the proximity of the photoreceptor, and a voltage of, for example, about −2.5 to −1.5 kV is applied to the charging unit to charge the photoreceptor so that the photoreceptor has desired polarity and potential. Such a proximity charge-type charging unit is not particularly limited, and a known means such as a charging roller, a charging brush, a charging belt, or a charging blade may be used. Among them, a charging roller is preferably used from the viewpoint of the stability of charging.

The application of a voltage to the charging unit may be performed using either a DC charging system in which only the direct electric field is applied to the charging unit to charge the photoreceptor or an AC charging system in which an electric field obtained by superimposing an alternating electric field on a direct electric field is applied to the charging unit to charge the photoreceptor. However, an AC charging system is preferred because a smoothing effect is obtained by an alternating electric field, and therefore excellent charging uniformity is achieved. That is, a preferred embodiment of the image forming apparatus according to the present invention includes the electrophotographic photoreceptor and the proximity charge-type charging unit in which AC is superimposed.

In the AC charging system, a voltage to be applied to the charging unit may be a direct electric field selected from a direct constant voltage and a direct constant current or an alternating electric field selected from an alternating constant voltage and an alternating constant current.

Hereinbelow, the image forming apparatus according to the present invention will be described with reference to the drawings.

Figure 2:
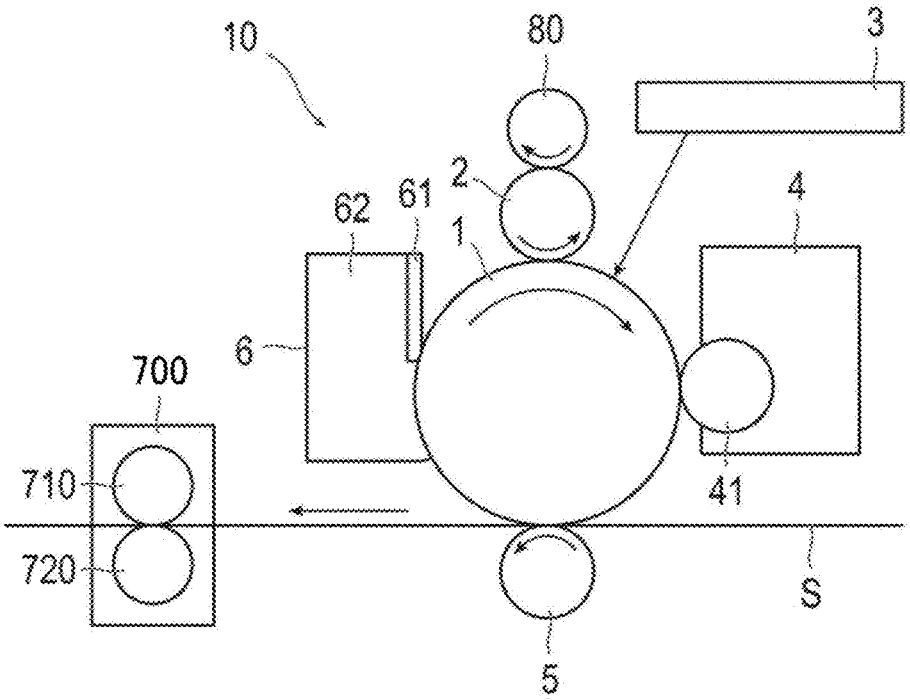
FIG. 2 is a schematic sectional view of an image forming apparatus according to an embodiment of the present invention.

FIG. 2 is a schematic sectional view of an image forming apparatus according to an embodiment of the present invention.

An image forming apparatus 10 shown in FIG. 2 includes a drum-shaped photoreceptor 1 as an image carrier. Around the photoreceptor 1, a charging unit (charging roller) 2, an exposure unit 3, a developing unit 4, a transfer unit (transfer roller) 5, and a cleaning unit 6 are disposed in this order. A cleaning device 80 is provided for the charging unit 2.

In FIG. 2, a fixing device 700 is disposed on the left side of the transfer roller 5. In this case, the fixing device 700 includes a fixing roller 710 incorporating a heat source such as a heater lamp and a pressure roller 720 facing the fixing roller 710.

In the image forming apparatus 10, the photoreceptor 1 is rotationally driven clockwise in FIG. 2 by a photoreceptor driving motor (not shown), and the surface of the photoreceptor 1 is uniformly charged by the charging roller 2 to have a predetermined potential. At this time, a voltage for charging is applied to the charging roller 2 by a power source for charging (not shown). The charging roller 2 may be one that can be rotated counterclockwise following the rotation of the photoreceptor 1 by contact with the surface of the photoreceptor 1. In this case, the charging roller 2 is rotated counterclockwise by contact with the photoreceptor 1, but is configured to be rotationally driven by a driving unit (not shown) to stabilize rotation.

The exposure unit 3 performs image exposure on the charged area of the photoreceptor charged to have a predetermined potential according to an image to be formed so that an electrostatic latent image is formed on the photoreceptor 1. This electrostatic latent image is developed by a developing roller 41 of the developing unit 4, to which a developing bias has been applied from a power source (not shown), to form a visible toner image.

It is to be noted that the image exposure by the exposure unit 3 is performed based on image information supplied from a scanner, a computer, or the like (not shown).

On the other hand, a transfer material (recording medium) S is supplied from a transfer material supply unit, and is once forced to wait by a pair of timing rollers (not shown). The transfer material S is sent between the photoreceptor 1 and the transfer roller 5 at the timing when the toner image on the photoreceptor 1 reaches between the photoreceptor 1 and the transfer roller 5 so that a target area of the transfer material S, on which an image is to be formed, just reaches between the photoreceptor 1 and the transfer roller 5. As a result, the toner image on the photoreceptor 1 is transferred onto the transfer material S by the transfer roller 5 to which a transfer voltage has been applied from a transfer power source (not shown).

The transfer material S onto which the toner image has been transferred in the above manner passes through the fixing device 700 so that the transferred toner image is fixed by the application of heat and pressure. Then, the transfer material S is discharged on a recording medium discharge tray (not shown).

In this case, the residual toner remaining on the photoreceptor 1 after transfer is removed by a cleaning blade 61 of the cleaning unit 6, and the removed residual toner is stored in a storage unit 62.

Here, the cleaning blade 61 to be used in this embodiment is made of, for example, an elastic material containing polyurethane rubber. The contact pressure between the cleaning blade 61 and the photoreceptor 1 is preferably set to about 1.96 to $5.88\times10^{-2}$ N/mm (2.0 to 6.0 gf/mm).

(Toner)

The toner to be used in this embodiment is not particularly limited, but is preferably one having a shape factor SF of less than 140 when the shape factor of a true sphere is 100. When the shape factor SF is less than 140, excellent transferability can be achieved, and therefore an image having improved image quality can be obtained. On the other hand, from the viewpoint of improving image quality, the volume average particle diameter of particles of the toner is preferably 2 to 8 μm.

The toner particles usually contain a binder resin and a colorant, and if necessary contains a release agent. These binder resin, colorant, and release agent are not particularly limited, and may be those conventionally used for toner.

A method for obtaining the toner particles is not particularly limited, and may be, for example, a conventional grinding method, a wet-melting spheronization method for preparation in a dispersion medium, or a known polymerization method such as suspension polymerization, dispersion polymerization, or emulsion polymerization aggregation.

Further, appropriate amounts of inorganic fine particles, such as silica or titania, having an average particle diameter of about 10 to 300 nm and an abrasive having a size of about 0.2 to 3 μm may be externally added to the toner particles as external additives, and the toner particles may be mixed with a carrier such as ferrite beads having an average particle diameter of 25 to 45 μm to obtain a developer.

Figure 3:
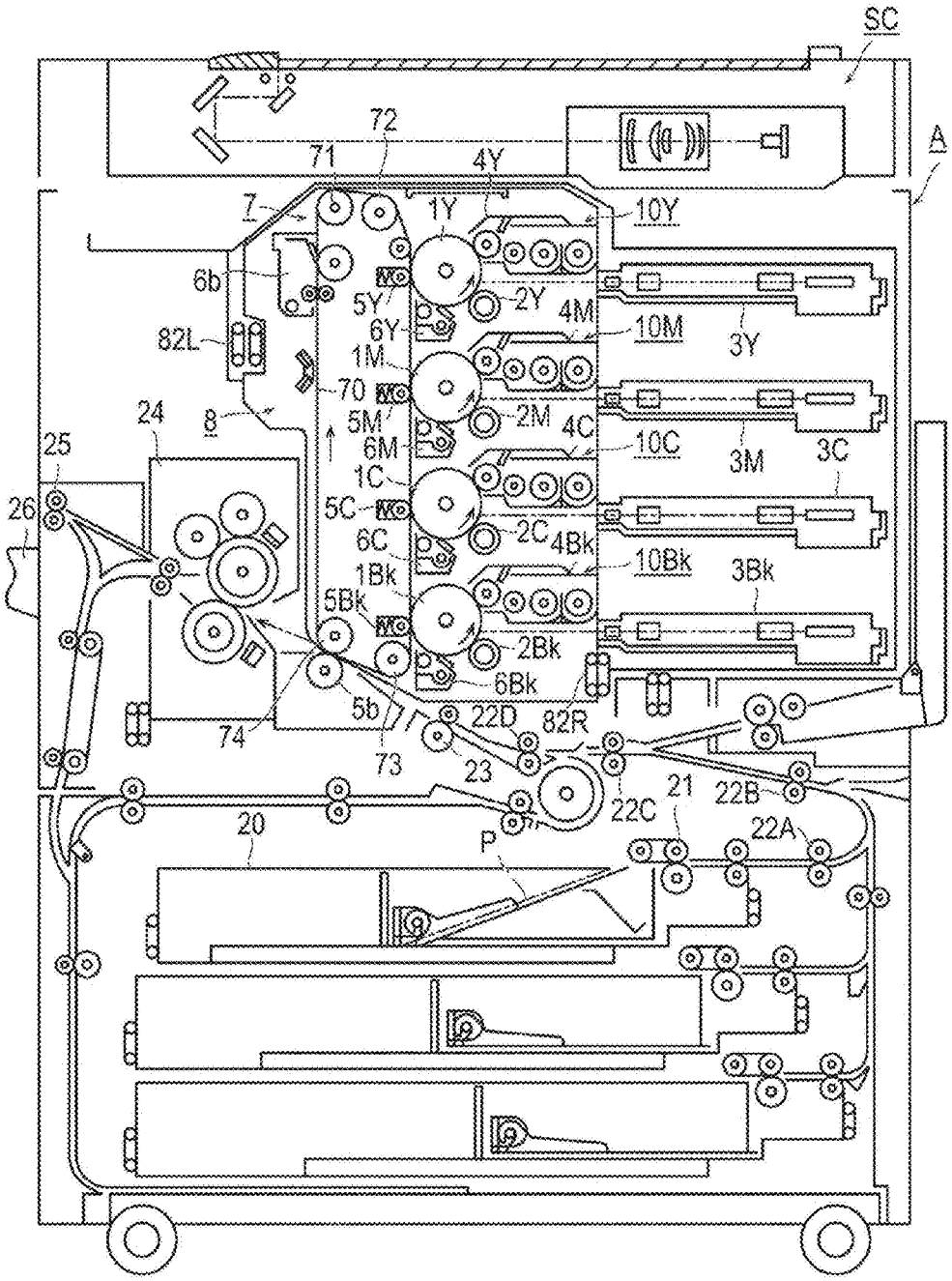
FIG. 3 is a schematic sectional view of a color image forming apparatus according to an embodiment of the present invention.

FIG. 3 is a schematic sectional view of a color image forming apparatus according to an embodiment of the present invention.

This color image forming apparatus is referred to as a tandem-type color image forming apparatus, and includes four sets of image forming units 10Y, 10M, 10C, and 10Bk, an endless belt-like intermediate transfer unit 7, a paper feeding and conveying unit 21, and a fixing unit 24. On the top of a main body A of the image forming apparatus, a copy image scanner SC is disposed.

The image forming unit 10Y that forms a yellow image includes a drum-shaped photoreceptor 1Y as a first image carrier, a charging roller as a charging unit (charging step) 2Y that is disposed around the drum-shaped photoreceptor 1Y to be in contact with the photoreceptor 1Y, an exposure unit (exposure step) 3Y, a developing unit (developing step) 4Y, a primary transfer roller 5Y as a primary transfer unit (primary transfer step), and a cleaning unit 6Y. The image forming unit 10M that forms a magenta image includes a drum-shaped photoreceptor 1M as a first image carrier, a charging unit 2M, an exposure unit 3M, a developing unit 4M, a primary transfer roller 5M as a primary transfer unit, and a cleaning unit 6M. The image forming unit 10C that forms a cyan image includes a drum-shaped photoreceptor 1C as a first image carrier, a charging unit 2C, an exposure unit 3C, a developing unit 4C, a primary transfer roller 5C as a primary transfer unit, and a cleaning unit 6C. The image forming unit 10Bk that forms a black image includes a drum-shaped photoreceptor 1Bk as a first image carrier, a charging unit 2Bk, an exposure unit 3Bk, a developing unit 4Bk, a primary transfer roller 5Bk as a primary transfer unit, and a cleaning unit 6Bk.

The four sets of image forming units 10Y, 10M, 10C, and 10Bk are composed of the centered photoreceptor drums 1Y, 1M, 1C, and 1Bk, the rotary charging unit 2Y, 2M, 2C, and 2Bk, the exposure unit 3Y, 3M, 3C, and 3Bk, the rotary developing unit 4Y, 4M, 4C, and 4Bk, and the cleaning unit 6Y, 6M, 6C, and 6Bk for cleaning the photoreceptor drums 1Y, 1M, 1C, and 1Bk.

The image forming units 10Y, 10M, 10C, and 10Bk have the same structure except that toner images formed on their respective photoreceptors 1Y, 1M, 1C, and 1Bk are different in color. Therefore, the image forming unit 10Y will be described in detail as an example.

In the image forming unit 10Y, the charging unit 2Y (hereinafter, simply referred to as charging unit 2Y or charger 2Y), the exposure unit 3Y, the developing unit 4Y, and the cleaning unit 6Y (hereinafter, simply referred to as cleaning unit 6Y or cleaning blade 6Y) are disposed around the photoreceptor drum 1Y as an image forming body to form a yellow (Y) toner image on the photoreceptor drum 1Y. In this embodiment, at least the photoreceptor drum 1Y, the charging unit 2Y, the developing unit 4Y, and the cleaning unit 6Y of the image forming unit 10Y are integrally provided.

The charging unit 2Y is a means for applying a uniform potential to the photoreceptor drum 1Y. In this embodiment, the charging roller-type charger 2Y is used for the photoreceptor drum 1Y.

The exposure unit 3Y is a means for forming an electrostatic latent image corresponding to a yellow image through exposure performed based on an image signal (yellow) on the photoreceptor drum 1Y to which a uniform potential has been applied by the charger 2Y. As the exposure unit 3Y, for example, one composed of an LED having light-emitting elements arranged in an array in the axial direction of the photoreceptor drum 1Y and an image forming element (trade name: SELFOC (registered trademark) lens) or a laser optical system is used.

In the image forming apparatus according to the present invention, the above-described photoreceptor and a component such as a developer or a cleaner may be integrally provided as a process cartridge (image forming unit) that can be detachably attached to the main body of the apparatus. Further, at least one of a charger, an image exposure device, a developer, a transfer or separation device, and a cleaner may be integrally supported together with the photoreceptor to form a process cartridge (image forming unit) as a single image forming unit that can be detachably attached to the main body of the apparatus with the use of a guiding unit such as a rail of the main body of the apparatus.

The endless belt-like intermediate transfer unit 7 includes an endless belt-like intermediate transfer body 70 that is a semiconductive endless belt-like second image carrier that is wrapped around two or more rollers and rotatably supported.

The individual color images formed by the image forming units 10Y, 10M, 10C, and 10Bk are successively transferred by the primary transfer rollers 5Y, 5M, 5C, and 5Bk as primary transfer unit onto the rotary endless belt-like intermediate transfer body 70 so that a composite color image is formed. A transfer material P as a transfer material (a support that carries a fixed final image, such as plain paper or a transparent sheet) contained in a paper cassette 20 is supplied by a paper feeding unit 21 and conveyed to a secondary transfer roller 5*b* as a secondary transfer unit through a plurality of intermediate rollers 22A, 22B, 22C, and 22D and a resist roller 23, and the color image is secondarily and collectively transferred onto the transfer material P. The transfer material P onto which the color image has been transferred is subjected to fixation by the fixing unit 24, nipped between paper ejection rollers 25, and placed on a paper catch tray 26 outside the apparatus. Here, a transfer support for a toner image formed on the photoreceptor, such as an intermediate transfer body or a transfer material, is collectively called transfer medium.

On the other hand, after the color image is transferred onto the transfer material P by the secondary transfer roller 5*b* as a secondary transfer unit, the cleaning unit 6*b* removes residual toner from the endless belt-like intermediate transfer body 70 from which the transfer material P has been self-stripped.

During image formation processing, the primary transfer roller 5Bk always abuts against the photoreceptor 1Bk. The other primary transfer rollers 5Y, 5M, and 5C abut against the corresponding photoreceptors 1Y, 1M, and 1C, respectively only during color image formation.

The secondary transfer roller 5*b* abuts against the endless belt-like intermediate transfer body 70 only when the transfer material P passes through the secondary transfer roller 5*b* for secondary transfer.

A housing 8 is configured to be drawable out of the apparatus main body A through support rails 82L and 82R.

The housing 8 includes the image forming units 10Y, 10M, 10C, and 10Bk and the endless belt-like intermediate transfer unit 7.

The image forming units 10Y, 10M, 10C, and 10Bk are tandemly disposed in a vertical direction. On the left side of the photoreceptors 1Y, 1M, 1C, and 1Bk shown in FIG. 3, the endless belt-like intermediate transfer unit 7 is disposed. The endless belt-like intermediate transfer unit 7 includes the endless belt-like intermediate transfer body 70 that is wrapped around rollers 71, 72, 73, and 74 so as to rotatably move, the primary transfer rollers 5Y, 5M, 5C, and 5Bk, and the cleaning unit 6*b*.

The present invention also provides an image forming method for forming an electrophotographic image using the above-described image forming apparatus. According to the image forming method of the present invention, it is possible to stably form an excellent electrophotographic image for a long time.

EXAMPLES

The effects of the present invention will be described based on the following examples and comparative examples. However, the technical scope of the present invention is not limited only to the following examples. It is to be noted that unless otherwise specified, "%" and "part(s)" mean "mass %" and "part(s) by mass", respectively.

It is to be noted that the average primary particle diameters of inorganic fine particles and organic fine particles were measured in the following manner.

<Average Primary Particle Diameter of Inorganic Fine Particles>

The average primary particle diameter of inorganic particles was measured in the following manner. An enlarged photograph of the inorganic particles was taken through a scanning electron microscope (manufactured by JEOL Ltd.) at a magnification of 10000. The image of the photograph was captured by a scanner and binarized by an automatic image analyzer "LUZEX (registered trademark) AP" (manufactured by NIRECO CORPORATION) using software Ver. 1.32, and the horizontal Feret diameter of each of the 300 particles randomly selected was measured to calculate a mean horizontal Feret diameter as a number-average primary particle diameter. Here, the horizontal Feret diameter refers to the length of a side, which is parallel to the x axis, of a rectangle circumscribing the binarized image of each of the inorganic fine particle.

<Average Primary Particle Diameter of Organic Fine Particles>

A photosensitive layer including a surface layer was cut out as a measurement sample from the surface of a photoreceptor with a knife or the like, and then the measurement sample was attached to an arbitrary holder so that its cutting surface faced upward. Then, the measurement sample was observed through a scanning electron microscope. A photograph was taken through a microscope at a magnification of 30000, and 100 organic fine particles were randomly extracted on the photographic image to calculate a number-average primary particle diameter. More specifically, the photographic image was binarized by an automatic image analyzer "LUZEX AP" (manufactured by NIRECO CORPORATION), and the horizontal Feret diameter of each of the 100 organic fine particles was measured to calculate an arithmetic mean. The arithmetic mean was defined as a number-average primary particle diameter of the organic fine particles.

<Production of Electrophotographic Photoreceptor>

The following intermediate layer, photosensitive layer, and surface layer were laminated in order on a conductive support in the following manner to produce an electrophotographic photoreceptor.

[Conductive Support]

The surface of an aluminum cylindrical body having a diameter of 60 mm was subjected to cutting work to prepare a conductive support having a finely-roughened surface.

[Formation of Intermediate Layer]

| | |
|---|---|
| Polyamide resin CM8000 (manufactured by Toray Industries, Inc.) | 1 part by mass |
| Titanium oxide SMT 500SAS (manufactured by TAYCA CORPORATION) | 3 parts by mass |
| Methanol | 10 parts by mass |

The above components were mixed, and the resulting mixture was dispersed using a sand mill for 10 hours. The thus obtained dispersion liquid was diluted twice with the same solvent, allowed to stand overnight, and filtered through a filter (filter pore size: 5 μm, Rigimesh (registered trademark) manufactured by Nihon Pall Manufacturing Ltd.) to prepare a coating liquid for forming an intermediate layer. The coating liquid was applied onto the conductive support by an immersion coating method and dried to form an intermediate layer having a dry film thickness of 2 μm.

[Formation of Photosensitive Layer]

(Formation of Charge Generation Layer)

| | |
|---|---|
| Charge generation material: Pigmemt (CG-1) described below | 20 parts by mass |
| Polyvinyl butyral resin #6000-C (manufactured by Denka Company Limited) | 10 parts by mass |
| tert-Butyl acetate | 700 parts by mass |
| 4-Methoxy-4-methyl-2-pentanone | 300 parts by mass |

The above components were mixed, and the resulting mixture was dispersed using a sand mill for 10 hours to prepare a coating liquid for forming a charge generation layer. The coating liquid for forming a charge generation layer was applied onto the intermediate layer by an immersion coating method and dried to form a charge generation layer having a dry film thickness of 0.3 μm.

<<Synthesis of Pigment (CG-1)>>

(1) Synthesis of Amorphous Titanyl Phthalocyanine

In 200 parts by mass of o-dichlorobenzene, 29.2 parts by mass of 1,3-diiminoisoindoline was dispersed. Then, 20.4 parts by mass of titanium tetra-n-butoxide was added thereto, and the resulting mixture was heated in a nitrogen atmosphere at 150 to 160° C. for 5 hours. After cooling, deposited crystals were collected by filtration, washed with chloroform, 2% hydrochloric acid, water, and methanol, and dried to obtain 26.2 parts by mass (yield: 91%) of crude titanyl phthalocyanine Then, the crude titanyl phthalocyanine was dissolved in 250 parts by mass of concentrated sulfuric acid with stirring at 5° C. or lower for 1 hour, and the resulting solution was poured into 5000 parts by mass of water at 20° C. Deposited crystals were collected by filtration and sufficiently washed with water to obtain 225 parts by mass of a wet paste product.

This wet past product was frozen in a freezer and again thawed. Then, filtration and drying were performed to obtain 24.8 parts by mass (yield: 86%) of amorphous titanyl phthalocyanine.

(2) Synthesis of Adduct of (2R,3R)-2,3-Butanediol and Titanyl Phthalocyanine (CG-1)

In 200 parts by mass of o-dichlorobenzene (ODB), 10.0 parts by mass of the above amorphous titanyl phthalocyanine and 0.94 parts by mass of (2R,3R)-2,3-butanediol (equivalent ratio: 0.6) (equivalent ratio refers to an equivalent ratio to titanyl phthalocyanine, the same applies hereinafter) were mixed. The resulting mixture was heated with stirring at 60 to 70° C. for 6 hours. After the mixture was allowed to stand overnight, methanol was added to the resulting reaction liquid to obtain crystals, and the crystals were collected by filtration. The crystals after filtration were washed with methanol to obtain 10.3 parts by mass of CG-1 (pigment containing an adduct of (2R,3R)-2,3-butanediol and titanyl phthalocyanine). In the X-ray diffraction spectrum of the pigment CG-1, clear peaks appeared at 8.3°, 24.7°, 25.1°, and 26.5°. In the mass spectrum of the pigment CG-1, peaks appeared at a molecular weight of 576 and a molecular weight of 648. In the IR spectrum of the pigment CG-1, absorption peaks derived from Ti═O and O—Ti—O appeared at about 970 $cm^{-1}$ and 630 $cm^{-1}$, respectively. The pigment CG-1 was subjected to thermal analysis (TG), and as a result, a mass reduction of about 7% was caused at 390 to 410° C. From the result, it was estimated that the CG-1 was a mixture of a 1:1 adduct of titanyl phthalocyanine and (2R,3R)-2,3-butanediol and titanyl phthalocyanine in a non-adduct form.

The BET specific surface area of the obtained pigment (CG-1) was measured by a flow-type specific surface area automatic measuring instrument (Micrometrics FlowSorb type, manufactured by SHIMADZU CORPORATION), and was found to be 31.2 $m^2/g$.

(Formation of Charge Generation Layer)

| | |
|---|---|
| Charge transport material: Compound A described below | 225 parts by mass |
| Polycarbonate resin Z300 (manufactured by Mitsubishi Chemical Corporation) | 300 parts by mass |
| Irganox (registered trademark) 1010 (manufactured by Ciba-Geigy Japan Ltd.) | 6 parts by mass |
| Tetrahydrofran | 1600 parts by mass |
| Toluene | 400 parts by mass |
| Silicone oil KF-50 (manufactured by Shin-Etsu Chemical Co., Ltd) | 1 part by mass |

The above components were mixed and dissolved to prepare a coating liquid for forming a charge transport layer. This coating liquid for forming a charge transport layer was applied onto the charge generation layer with the use of a circular slide hopper coater and dried to forma charge transport layer having a dry film thickness of 27.7 μm.

[Chemical Formula 7]

Compound A

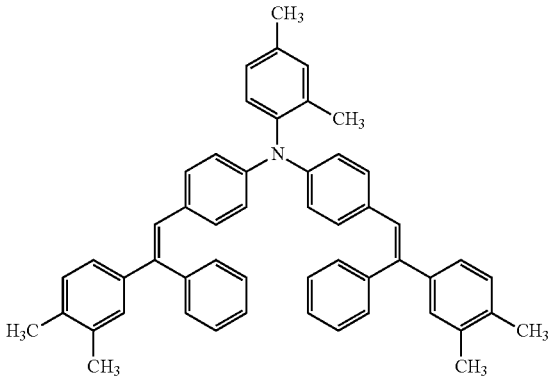

[Formation of Surface Layer]
(Preparation of Inorganic Fine Particles)

Production Example 1

In 10 mL of tetrahydrofuran, 2.5 g of the compound S-15 exemplified above was dissolved, and the resulting solution was stirred. This solution was dropped onto 20.0 g of "AEROSIL (registered trademark) 200" (average primary particle diameter: 12 nm) manufactured by NIPPON AEROSIL CO., LTD. with the use of a glass Pasteur pipette over about 2 minutes. Then, the powder was transferred into a 1 liter-separable flask and heated in a nitrogen stream for 2 hours with stirring. At this time, the flow rate of nitrogen was 200 mL/min. In such a manner as described above, inorganic fine particles 1 were prepared.

The volume resistivity of the inorganic fine particles 1 was calculated by the above described method using a digital ultrahigh resistance/minute-current ammeter (TR8611A manufactured by ADVANTEST CORPORATION), and was found to be $2.6\times10^{14}\Omega\cdot$cm.

Production Example 2

Inorganic fine particles 2 were prepared in the same manner as in Production Example 1 except that AEROSIL (registered trademark) 200 was changed to "$Al_2O_3$ Nanotek (registered trademark)" (average primary particle diameter: 31 nm) manufactured by C.I. Kasei Company, Limited. The volume resistivity of the obtained inorganic fine particles 2 was $2.4\times10^{15}\Omega\cdot$cm.

Production Example 3

Inorganic fine particles 3 were prepared in the same manner as in Production Example 1 except that AEROSIL (registered trademark) 200 was changed to "SFP-20M" (average primary particle diameter: 30 nm) manufactured by Denka Company Limited. The volume resistivity of the obtained inorganic fine particles 3 was $3.8\times10^{14}\Omega\cdot$cm.

Production Example 4

Inorganic fine particles 4 were prepared in the same manner as in Production Example 1 except that AEROSIL (registered trademark) 200 was changed to "AEROSIL (registered trademark) OX50" (average primary particle diameter: 40 nm) manufactured by NIPPON AEROSIL CO., LTD. The volume resistivity of the obtained inorganic fine particles 4 was $1.0\times10^{15}\Omega\cdot$cm.

Production Example 5

Inorganic fine particles 5 were prepared in the same manner as in Production Example 1 except that AEROSIL (registered trademark) 200 was changed to "$SnO_2$ Nanotek (registered trademark)" (average primary particle diameter: 21 nm) manufactured by C.I. Kasei Company, Limited. The volume resistivity of the obtained inorganic fine particles 5 was $1.1\times10^{9}\Omega\cdot$cm.

Non-surface-treated "AEROSIL (registered trademark) OX50" (average primary particle diameter: 40 nm) manufactured by NIPPON AEROSIL CO., LTD. was prepared as inorganic fine particles 6. The volume resistivity of the inorganic fine particles 6 was $1.0\times10^{15}\Omega\cdot$cm.

(Formation of Surface Layer)

Example 1

First, 50 parts by mass of a charge transport material (represented by the above chemical formula (1)), 100 parts by mass of a polymerizable compound (Compound M1 exemplified above), 15 parts by mass of the inorganic fine particles 1 ($SiO_2$ surface-treated with the above-described surface treatment agent S-15), 25 parts by mass of the organic fine particles 1 (manufactured by NIPPONPAINT Co., Ltd., FINE SPHERE MG-351, number-average primary particle diameter: 1.0 μm), 400 parts by mass of 2-butanol, and 40 parts by mass of tetrahydrofuran were mixed under light-shielding conditions. The resulting mixture was dispersed for 5 hours using a sand mill as a disperser. Then, 10 parts by mass of a polymerization initiator (Irgacure (registered trademark) 819 manufactured by BASF Japan Ltd.) was added thereto, and the resulting mixture was stirred for dissolution under light-shielding conditions to prepare a coating liquid for forming a surface layer.

This coating liquid for forming a surface layer was applied onto the above-described charge transport layer with the use of a circular slide hopper coater and dried at room temperature (25° C.) for 20 minutes to forma coating film. Then, the coating film was irradiated with light for 1 minute with the use of a metal halide lamp (output: 500 W) while a photoreceptor was rotated at a distance of 100 mm to form a surface layer having a dry film thickness of 3.5 μm. In this way, a photoreceptor 1 was produced.

Examples 2 to 10 and Comparative Examples 1 to 5

Photoreceptors 2 to 15 were produced in the same manner as in Example 1 except that the compositions of the surface layer and the photosensitive layer were changed as shown in Table 1. It is to be noted that organic fine particles 2 to 4 used for forming the surface layer are as follows.

Organic fine particles 2: Melamine-formaldehyde condensation resin particles (EPOSTAR (registered trademark) S6 manufactured by NIPPON SHOKUBAI CO., LTD., number-average primary particle diameter: 0.4 μm)

Organic fine particles 3: Melamine-formaldehyde condensation resin particles (EPOSTAR (registered trademark) S12 manufactured by NIPPON SHOKUBAI CO., LTD., number-average primary particle diameter: 1.0 μm)

Organic fine particles 4: Melamine-formaldehyde condensation resin particles (EPOSTAR (registered trademark) S manufactured by NIPPON SHOKUBAI CO., LTD., number-average primary particle diameter: 0.2 μm)

<Preparation of Image forming Apparatus for Evaluation>

Each of the photoreceptors was installed as an electrophotographic photoreceptor in an image forming apparatus ("bizhub (registered trademark) C554" manufactured by KONICA MINOLTA JAPAN, INC.), and the charging system of an image forming unit was changed to a proximity charging system. The following evaluations were made using the thus obtained image forming apparatus.

<Performance Evaluations of Photoreceptor>

[Evaluation of Wear Resistance]

A character chart having a coverage rate of 5% was printed on 30000 sheets of paper using the image forming apparatus for evaluation. Then, the film thickness of the surface layer of the photoreceptor was measured, and the wear amount of the surface layer was calculated and evaluated according to the following criteria. It is to be noted that the film thickness was measured using an eddy-current film thickness gauge "FISCHER SCOPE MMS PC" (manufactured by Fischer Instruments K.K.).

A: The wear amount is less than 0.3 μm.

B: The wear amount is 0.3 μm or more but less than 0.6 μm.

C: The wear amount is 0.6 μm or more.

[Evaluation of Transfer Memory Resistance]

A character chart (coverage rate: 5%) having both solid black and solid white was continuously printed on 100000 sheets of A3 paper using the image forming apparatus for evaluation. Then, a halftone image was printed on 10 sheets of A3 paper to evaluate whether the history of the solid black and the solid white appeared in the halftone image. More specifically, a difference (ΔID) between the reflected density of an area corresponding to the solid back image in the halftone image and the reflected density of an area corresponding to the solid white image in the halftone image was determined using a Macbeth reflection densitometer "RD-918" (manufactured by Gretag Macbeth) and evaluated according to the following criteria.

A: ΔID is 0.05 or less (Excellent).

B: ΔID is more than 0.05 but 0.10 or less (acceptable in practical use).

C: ΔID is more than 0.10 (unacceptable in practical use).

[Evaluation of Image Deletion Resistance]

A character chart having a coverage rate of 5% was continuously printed on 2000 sheets of A3 paper using the image forming apparatus for evaluation under high-temperature and high-humidity conditions (temperature: 30° C., relative humidity: 85% RH). Then, a halftone image was printed on a sheet of A3 paper.

The image forming apparatus for evaluation was turned off, allowed to stand for 8 hours, and turned on again. A halftone image was continuously printed on 20 sheets of A3 paper. The printed halftone image was visually observed, and the number of sheets of paper required to recover the quality of the printed halftone image to the quality of the halftone image for reference was counted and evaluated according to the following criteria.

A: 3 sheets of paper or less

B: 4 sheets of paper or more but 7 sheets of paper or less

C: 8 sheets of paper or more but 10 sheets of paper or less

D: 11 sheets of paper or more

[Evaluation of Durability]

A character chart having a coverage rate of 5% was continuously printed on 100000 sheets of A3 paper using the image forming apparatus for evaluation. Then, a halftone image was printed on one sheet of A3 paper. The surface of the electrophotographic photoreceptor installed in the image forming apparatus for evaluation was visually observed to determine whether or not streaks had been formed and whether or not filming (caused by a residual electrostatic latent image developer or external additive) had occurred. Further, the printed halftone image was visually observed to determine the presence or absence of an image defect. Based on these observation results, the durability of the electrophotographic photoreceptor was evaluated according to the following criteria.

A: No defect is observed in both the halftone image and the photoreceptor surface.

C: Defects are observed in both the halftone image and the photoreceptor surface.

TABLE 1

| | | (A) Charge Transport Material | | (b1) Polymerizable Compound | | (b2) Inorganic Fine Particles | | | |
|---|---|---|---|---|---|---|---|---|---|
| | Photoreceptor No. | No. | Content (parts by mass) | No. | Content (parts by mass) | No. | Type of Metal Oxide | Particle Diameter before Surface Treatment (nm) | Type of Surface Treatment Agent |
| Example 1 | 1 | 1 | 50 | M1 | 100 | 1 | $SiO_2$ | 12 | S-15 |
| Example 2 | 2 | 1 | 50 | M1 | 100 | 2 | $Al_2O_3$ | 31 | S-15 |
| Example 3 | 3 | 2 | 50 | M1 | 100 | 1 | $SiO_2$ | 12 | S-15 |
| Example 4 | 4 | 3 | 40 | M1 | 100 | 1 | $SiO_2$ | 12 | S-15 |
| Example 5 | 5 | 3 | 40 | M1 | 100 | 3 | $SiO_2$ | 30 | S-15 |
| Example 6 | 6 | 4 | 40 | M1 | 100 | 3 | $SiO_2$ | 30 | S-15 |
| Example 7 | 7 | 4 | 35 | M1 | 100 | 4 | $SiO_2$ | 40 | S-15 |
| Example 8 | 8 | 4 | 35 | M1 | 100 | 4 | $SiO_2$ | 40 | S-15 |
| Example 9 | 9 | 5 | 35 | M1 | 100 | 3 | $SiO_2$ | 30 | S-15 |
| Example 10 | 10 | 5 | 35 | M1 | 100 | 4 | $SiO_2$ | 40 | S-15 |
| Comparative Example 1 | 11 | — | 0 | M1 | 100 | 3 | $SiO_2$ | 30 | S-15 |
| Comparative Example 2 | 12 | 2 | 40 | M1 | 100 | 3 | $SiO_2$ | 30 | S-15 |
| Comparative Example 3 | 13 | 2 | 40 | M1 | 100 | — | — | — | — |
| Comparative Example 4 | 14 | 3 | 40 | M1 | 100 | 6 | $SiO_2$ | 40 | — |

TABLE 1-continued

| | | | | | | | | | |
|---|---|---|---|---|---|---|---|---|---|
| Comparative Example 5 | 15 | 2 | 40 | M1 | 100 | 5 | $SnO_2$ | 21 | S-15 |

| | (b2) Inorganic Fine Particles | | (C) Organic Fine Particles | | | | Film Thickness | |
|---|---|---|---|---|---|---|---|---|
| | Content (parts by mass) | Volume Resistivity (Ω · cm) | No. | Type* | Particle Diameter (μm) | Content (parts by mass) | Surface Layer (μm) | Photo-sensitive Layer (μm) |
| Example 1 | 15 | $2.6 \times 10^{14}$ | 1 | SA | 1.0 | 25 | 3.5 | 28 |
| Example 2 | 15 | $2.4 \times 10^{15}$ | 1 | SA | 1.0 | 25 | 3.5 | 28 |
| Example 3 | 15 | $2.6 \times 10^{14}$ | 1 | SA | 1.0 | 25 | 3.5 | 25 |
| Example 4 | 20 | $2.6 \times 10^{14}$ | 2 | MH | 0.4 | 25 | 2.5 | 20 |
| Example 5 | 20 | $3.8 \times 10^{14}$ | 3 | MH | 1.0 | 25 | 2.5 | 15 |
| Example 6 | 30 | $3.8 \times 10^{14}$ | 2 | MH | 0.4 | 30 | 2.5 | 20 |
| Example 7 | 20 | $1.0 \times 10^{15}$ | 2 | MH | 0.4 | 15 | 2 | 15 |
| Example 8 | 30 | $1.0 \times 10^{15}$ | 3 | MH | 1.0 | 20 | 2 | 17 |
| Example 9 | 30 | $3.8 \times 10^{14}$ | 4 | MH | 0.2 | 20 | 2 | 17 |
| Example 10 | 30 | $1.0 \times 10^{15}$ | 2 | MH | 0.4 | 20 | 2 | 17 |
| Comparative Example 1 | 30 | $3.8 \times 10^{14}$ | 1 | MH | 1.0 | 20 | 3.5 | 28 |
| Comparative Example 2 | 30 | $3.8 \times 10^{14}$ | — | — | — | 0 | 2.5 | 15 |
| Comparative Example 3 | 0 | — | 4 | MH | 0.2 | 25 | 3 | 20 |
| Comparative Example 4 | 30 | $5.2 \times 10^{14}$ | 4 | MH | 0.2 | 25 | 3 | 15 |
| Comparative Example 5 | 30 | $1.1 \times 10^{9}$ | 1 | MH | 1.0 | 20 | 3.5 | 28 |

SA: Styreneacrylic Particles,
MH: Melamine-Formaldehyde Condensation Resin Particles

TABLE 2

| | | Performance Evaluation | | | |
|---|---|---|---|---|---|
| | Photo-receptor No. | Wear Resistance | Transfer Memory Resistance | Image Deletion Resistance | Durability |
| Example 1 | 1 | A | B | B | A |
| Example 2 | 2 | A | B | B | A |
| Example 3 | 3 | B | B | B | A |
| Example 4 | 4 | B | A | B | A |
| Example 5 | 5 | A | A | A | A |
| Example 6 | 6 | A | A | A | A |
| Example 7 | 7 | B | B | B | A |
| Example 8 | 8 | B | A | B | A |
| Example 9 | 9 | B | A | B | A |
| Example 10 | 10 | B | A | B | A |
| Comparative Example 1 | 11 | B | C | C | C |
| Comparative Example 2 | 12 | C | C | D | C |
| Comparative Example 3 | 13 | C | C | D | C |
| Comparative Example 4 | 14 | C | C | C | C |
| Comparative Example 5 | 15 | C | C | D | C |

From the results shown in Table 2, the photoreceptors 1 to 10 according to the present invention had excellent wear resistance, transfer memory resistance, image deletion resistance, and durability. Particularly, the photoreceptors 5 and 6 were evaluated as A in all the evaluation items. This result reflects the fact that the components of the surface layer (charge transport material, inorganic fine particles, organic fine particles) are closely associated with wear resistance, transfer memory resistance, and image deletion resistance. The amounts of the components contained in the surface layer are within appropriate ranges, which is considered to be the reason why each of the photoreceptors maintains the above excellent performance while maintaining resistance to proximity electric discharge.

On the other hand, the photoreceptors 11 to 13 (Comparative Examples 1 to 3) whose surface layer was lack in any one of its components (charge transport material, inorganic fine particles, organic fine particles), the photoreceptor 14 (Comparative Example 4) using non-surface-treated inorganic fine particles in its surface layer, and the photoreceptor 15 (Comparative Example 5) using inorganic fine particles having a volume resistivity of less than $1.2\times10^{11}\Omega\cdot$cm in its surface layer could not achieve such performance that all the evaluation items were satisfied.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An electrophotographic photoreceptor for use in an image forming apparatus having a proximity charge-type charging unit, the electrophotographic photoreceptor comprising a conductive support and at least photosensitive layer and surface layer laminated in order on the conductive support, wherein the surface layer comprises (A) a charge transport material, (B) a cured product of a composition containing a polymerizable compound and inorganic fine particles, and (C) organic fine particles, and the inorganic fine particles contain a metal oxide, has a surface treated with a surface treatment agent having a reactive organic group, and has a volume resistivity of $1.2\times10^{11}\Omega\cdot$cm or more.

2. The electrophotographic photoreceptor according to claim 1, wherein the metal oxide is $SiO_2$ or $Al_2O_3$.

3. The electrophotographic photoreceptor according to claim 1, wherein the charge transport material is represented by the following general formula (1):

[Chemical Formula 1]

(1)

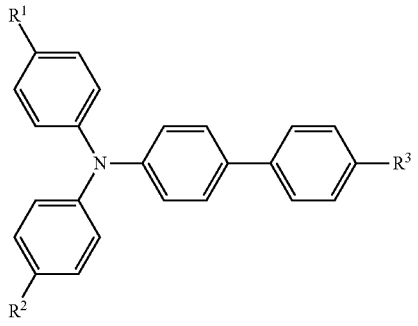

wherein, $R^1$ and $R^2$ are each independently a hydrogen atom or a methyl group, and $R^3$ is a linear or branched alkyl group having 1 to 5 carbon atoms, a methacryloyloxy group, or an acryloyloxy group.

4. The electrophotographic photoreceptor according to claim 1, wherein the photosensitive layer has a film thickness of 15 μm or more but 20 μm or less.

5. The electrophotographic photoreceptor according to claim 1, wherein the organic fine particles are melamine-formaldehyde condensation resin particles.

6. An image forming apparatus comprising:

the electrophotographic photoreceptor according to claim 1; and the proximity charge-type charging unit in which AC is superimposed.

7. A method for forming an image, comprising forming an electrophotographic image with a use of the image forming apparatus according to claim 6.

* * * * *